United States Patent [19]

Haggerty

[11] 4,219,314

[45] Aug. 26, 1980

[54] ROLLING PISTON ROTARY COMPRESSOR

[75] Inventor: Dennis M. Haggerty, Bloomington, Minn.

[73] Assignee: Thermo King Corporation, Minneapolis, Minn.

[21] Appl. No.: 5,124

[22] Filed: Jan. 22, 1979

[51] Int. Cl.[2] ..... F04C 17/02; F04C 29/10

[52] U.S. Cl. ..... 418/24; 418/29; 418/57; 418/63

[58] Field of Search ..... 418/24, 26, 29, 57, 418/63–67

[56] References Cited

U.S. PATENT DOCUMENTS

| | | | |
|---|---|---|---|
| 1,516,817 | 11/1921 | Hawkins | 418/67 |
| 1,603,983 | 10/1926 | Rolaff | 418/63 |
| 2,181,168 | 11/1939 | Barnes | 418/57 |
| 2,341,231 | 2/1944 | Nordling | 418/63 |
| 2,460,617 | 2/1949 | Balough | 418/57 |

FOREIGN PATENT DOCUMENTS

| | | | |
|---|---|---|---|
| 534169 | 2/1941 | United Kingdom | 418/66 |

*Primary Examiner*—John J. Vrablik

*Attorney, Agent, or Firm*—E. F. Possessky

[57] ABSTRACT

A rotary compressor 10 of the rolling piston type is shown wherein the rolling cylindrical piston 28 is forced into rolling contact with the cylindrical interior 15 of the compressor chamber by a hydraulic piston 78 and cylinder 64 arrangement providing a resilient force on the rolling piston 28 to permit non-compressible matter such as liquid refrigerant to be present in the compressor chamber and also, through means 82 for varying the hydraulic pressure to the hydraulic piston and cylinder arrangement, permit varying the compressor discharge pressure while the rolling piston is continuously driven.

5 Claims, 1 Drawing Figure

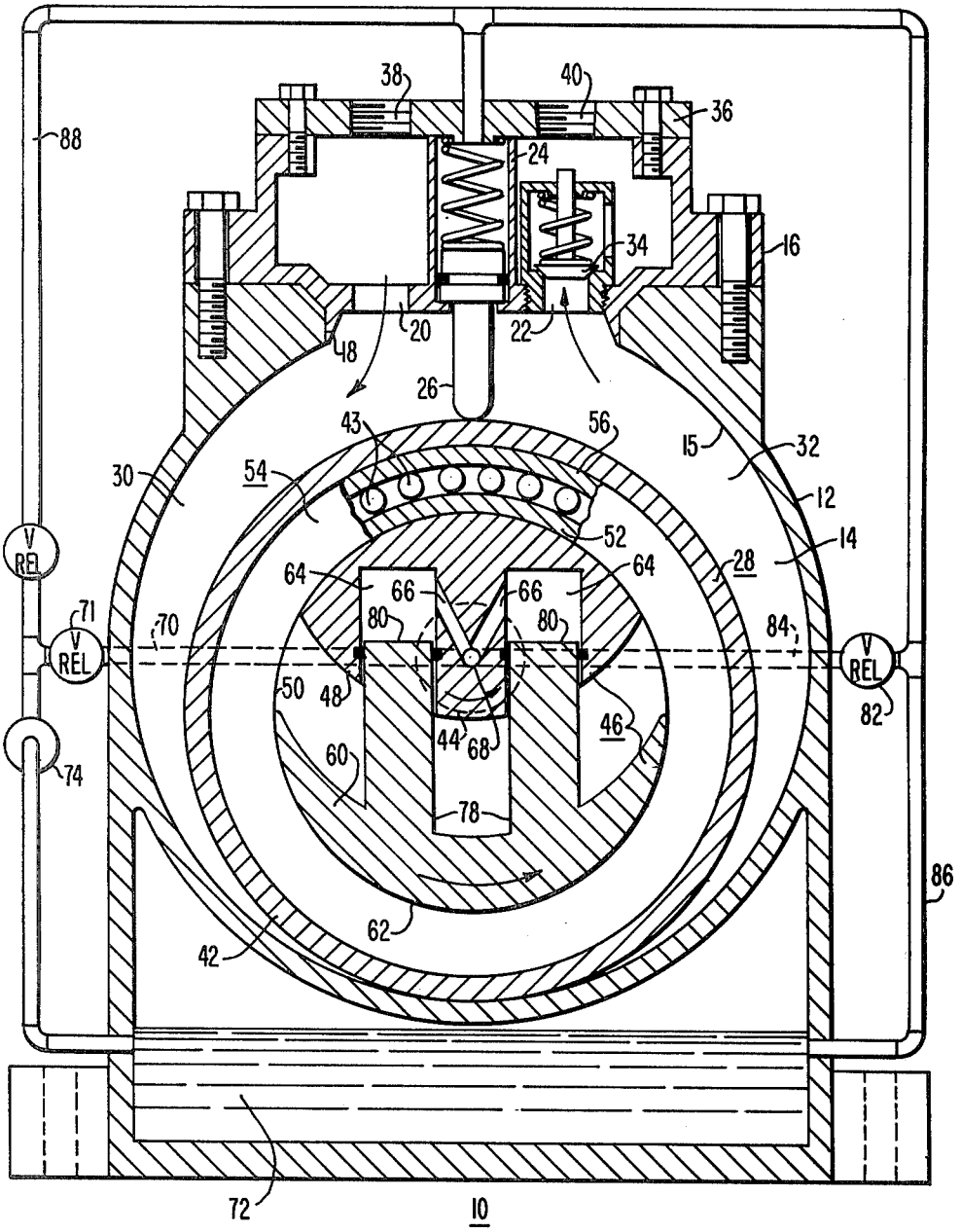
38
40
36
88
24
34
16
20
22
48
26
43
56
15
32
30
54
12
52
14
28
64
66
66
64
71
70
80
80
84
V
REL
V
REL
V
REL
50
48
44
68
46
82
60
74
78
86
62
42
72
10

ROLLING PISTON ROTARY COMPRESSOR

BACKGROUND OF THE INVENTION

1. Field of the Invention

This invention relates to a rotary compressor and more particularly to the type of rotary compressor having a rotating piston.

2. Description of the Prior Art

Rotary pumps and compressors of the type having a rotating piston are well known in the art and generally comprise a housing defining a cylindrical chamber having an inlet and outlet and housing a cylindrical roller or piston of lesser diameter. The rolling piston is driven in rolling contact with the inside wall of the chamber and a retractable divider member extends outwardly from the chamber wall to sealingly engage the piston between the inlet and outlet opening and divide the chamber into an inlet or low pressure side and an exhaust or high pressure side. The rolling piston is driven about the inner wall of the chamber by an eccentric crank member on the axially disposed drive shaft of the compressor. For the most part, the eccentric crank is a solid member configured to force the rolling piston into compressive engagement with the chamber wall. However, in some instances, it is conceivable that a non-compressible material, such as liquid refrigerant, would enter the compressor chamber along with vapors to be compressed therein. This liquid material, being non-compressible, is quite apt to damage the compressor.

It is known in pumps having similar rolling piston configurations as the compressor of the instant invention to have a yieldable (e.g. spring) crank arm or linkage forcing the rolling piston into compressive engagement. This permits the non-compressible material in the pumped fluid to pass through the pump without damage thereto. U.S. Pat. No. 2,460,617 discloses a pump of this nature.

Further, it is recognized that the pumping capacity of a rotary pump can be regulated by adjusting the amount of eccentricity of the roller (e.g. from its full eccentric position in rolling contact against the inner wall of the pumping chamber providing maximum pumping capacity to a position of concentricity with the drive shaft wherein the pump would have no pumping capacity). However, such mechanical linkage involves a multiplicity of parts. U.S. Pat. No. 2,266,191 shows a mechanism in a rotary pump for adjusting the pump capacity.

SUMMARY OF THE INVENTION

The present invention provides a rotary compressor having a rolling piston resiliently urged into its normal operating position in rolling contact with the compressor chamber. The resilient forces are developed by a hydraulic arrangement within the eccentric crank members to resiliently force the rolling piston against the chamber wall, however, upon encountering a non-compressible material, the force on the hydraulic arrangement is such as to permit retraction of the rolling piston so it could pass thereover. Further, by completely relieving the hydraulic pressure on the crank mechanism, the capacity of the compressor can be reduced to zero.

DESCRIPTION OF THE DRAWING

The FIGURE is a cross sectional elevational schematic view of the rotary compressor according to the present invention.

DESCRIPTION OF THE PREFERRED EMBODIMENT

Referring to the FIGURE, a rotary compressor 10 is schematically shown and is seen to comprise an outer housing 12 defining an interior cylindrical chamber 14 having an interior wall 15. A compressor head 16 is disposed over an opening 18 into the chamber 14 and defines an inlet port 20, an outlet or high pressure port 22 and a sleeve 24 having a divider member 26 received for reciprocal movement therein. Divider 26 extends from the sleeve to project radially into the chamber and ride on the surface of an eccentric rotating piston 28, to be described later, and divide the inner cylindrical chamber 14 into a suction side 30 and a discharge side 32. Outlet port 22 has disposed therein a check valve 34 permitting high pressure flow outwardly of the discharge side 32 of the compressor. A plate member 36 covers the ports 20, 22 in the compressor head and defines threaded apertures 38, 40 for fittings to refrigerant tubes (not shown) to route the vaporized refrigerant through the compressor 10.

The rotating piston 28, as is well known in the art, comprises a cylindrical member 42 having a smaller diameter than the inner diameter of the cylindrical compressor chamber 14 so as to define the suction and discharge space 30, 32. Also, the axis of the cylindrical member 42 is eccentric to the axis of the chamber 14, and a drive shaft 44, concentric to the cylindrical chamber, drives the member 42 in substantially rolling contact between the inner surface 15 of the chamber and the outer surface of the member by an eccentric crank 46.

In the instant invention, the eccentric crank 46 comprises a first crank member 48 integrally attached to the drive shaft 44 and in driving engagement with an internal cylindrical surface 50 of an inner race 52 of a roller bearing 54. The outer race 56 of the bearing 54 engages the cylindrical member 42. Roller bearings 43 are interposed between the inner and outer race to provide a rolling drive between the shaft 44 and the rolling piston 28 to minimize friction. Thus, it is seen that rotation of the drive shaft 44 and crank 46 will drive the member 42 in a rolling engagement with the inner wall 15 of the cylindrical chamber 14.

As is further seen, the crank member 46 includes a second crank member 60 spatially separated from the first crank 46 with each crank member 46, 60 being substantially diametrically opposed. Crank 60 also has an arcuate face 62 in driving engagement with the inner face 50 of the inner race 52.

The first crank member 46 defines a pair of parallel cavities 64 having sidewalls substantially parallel to the direction of the diametrically opposed position of the second crank member 60 and open on the face facing the second crank member. Each cavity 64 is in fluid flow communication through passages 66 in the crank member 46, to a common fluid passage 68 in the drive shaft 44. This passage 68 is supplied fluid under pressure, such as through an oil line 70 circulating the lubricating oil from an oil reservoir 72 via an oil pump 74 which can also be driven from a power source common to the compressor 10. The pressure in line 70 can be varied as through a pressure regulating valve 71.

The second crank member 60 has a pair of integral finger-like parallel projections 78 extending therefrom and so sized and placed for each to be received within a respective opposing cavity 64 in the first crank member 46 and in generally close relationship therewith so as to act like hydraulic pistons under the influence of the fluid pressure within the cavities 46. Thus, under these conditions, the fluid pressure on the faces 80 of the projections 78 forces the second crank 60 into engagement with the face 50 of the inner race 52 which in turn forces the rolling piston 28 into rolling engagement with the inner face 15 of the cylindrical chamber 14. However, if any non-compressible material, such as liquid refrigerant, is returned to the suction side 30 of the compressor chamber 14, the force on the rolling piston 28 by such non-compressible material will exceed (by design) the hydraulic force on the second crank member 60 by the hydraulic pressure such that the pistons 78 will be permitted to slide into the cavities 64 in the first crank member 48 permitting the rolling piston 28 to roll over the non-compressible material without damage. To accommodate the necessary discharge of oil from the cavities 64 under such conditions without backflow through the pump 74, a pressure relief valve 82 is placed on an oil line 84 downstream thereof in communication with an oil return line 86 to the oil reservoir 72. It must be emphasized that the pressure on the pistons 78 must establish a sufficient force to maintain intimate rolling contact between the rolling piston 28 and the inner face 15 of the cylinder during the complete travel of the rolling piston. However, it is also apparent that by eliminating oil flow to the cavities 64, as through a bypass of the oil flow to the cavities, there is insufficent pressure on the hydraulic piston 28 to maintain the intimate rolling contact and, in effect, the rolling piston will continue to be driven by the drive shaft 44, however, there will be no compression of fluid within the compressor chamber 14.

It should be herein pointed out that for the rolling piston 28 to roll over a non-compressible material, the inner race 52 will become lifted from the arcuate face of the first crank 48. Thus, to accommodate this, the arcuate dimension of the first crank 48 must be less than 180° (i.e. it cannot extend across the diameter of the inner race 52) to permit such relative movement between the race 52 and the first crank member 48. Under such conditions, the torque to the rolling piston 28 is delivered by the second crank 60 through the hydraulic pistons or projections 78.

Also shown in the preferred embodiment is a second oil pressure line 88 directing oil to the sleeve 24 to maintain a force on the divider 26 slidingly housed therein to maintain it in intimate sealing contact with the surface of the rolling piston 28. However, it is also known that a spring or the high pressure refrigerant discharge from the compressor can also be used in this sleeve to maintain such sealing force.

Thus, in a rolling piston rotary compressor, there is shown a means for hydraulically maintaining the rolling piston in compressive rolling contact with the internal cylindrical chamber to provide the desired compression of the fluid in the compressor chamber and also permitting unloading of the compressor while it continues to rotate. It is axiomatic that by varying the hydraulic pressure to the pistons, the discharge pressure of the compressor can be altered.

I claim:

1. In a rotary compressor having a casing defining a generally cylindrical chamber, a rolling piston within said chamber, and crank means for driving said piston, said crank means attached to a drive shaft and comprising: a first crank member integral with said drive shaft in engagement with an arcuate portion of the internal cylindrical face of said rolling piston; a spatially separated second crank member in engagement with a diametrically opposed arcuate portion of said cylindrical face; and wherein said first crank member includes a hydraulic cylinder means in fluid flow communication with pressurized fluid through a fluid passage in said crankshaft and said second crank member defines hydraulic piston means projecting across said spatial separation and into said cylinder means; and, means for adjusting the fluid pressure on said fluid to said cylinder means to vary the force separating said crank members;

wherein said pressure on said fluid in said cylinder means maintains said spatial separation under normal compressor operations to maintain said rolling piston in rolling contact with the interior of said chamber and permits retraction of said piston means within said cylinder means for said rolling piston to pass over non-compressible material within said chamber.

2. Structure according to claim 1 wherein said rolling piston is radially movable with respect to at least said first crank member permitting said piston to pass over non-compressible material.

3. Structure according to claim 1 wherein the dimension of arcuate engagement between said first crank member and said internal cylindrical face of said rolling piston is less than half of the circumference of the face.

4. Structure according to claim 3 comprising a plurality of said cylinder means and respective piston means and wherein the walls of said cylinder means are substantially parallel and parallel to a line connecting the center of axis of said crank and the point of rolling contact between said rolling piston and said chamber.

5. Structure according to claim 4 wherein said internal cylindrical face at said rolling piston comprises the inner face of the inner race of a roller bearing and wherein the outer race of the outer face of said bearing engages the inner face of a cylindrical member in rolling contact with said chamber and a plurality of spherical bearing members separating said inner and outer race.

* * * * *